US007476129B2

(12) United States Patent
Droesbeke et al.

(10) Patent No.: US 7,476,129 B2
(45) Date of Patent: Jan. 13, 2009

(54) CABLE CONNECTOR AND METHOD FOR ASSEMBLING SUCH A CONNECTOR

(75) Inventors: Gert Droesbeke, Geel (BE); Sandra Van Humbeeck, Zaventhem (BE)

(73) Assignee: FCI, Versilles (FR)

( * ) Notice: Subject to any disclaimer, the term of this patent is extended or adjusted under 35 U.S.C. 154(b) by 0 days.

(21) Appl. No.: 10/538,535

(22) PCT Filed: Dec. 12, 2003

(86) PCT No.: PCT/EP03/50995

§ 371 (c)(1),
(2), (4) Date: Jan. 24, 2006

(87) PCT Pub. No.: WO2004/055942

PCT Pub. Date: Jul. 1, 2004

(65) Prior Publication Data

US 2006/0134988 A1 Jun. 22, 2006

(30) Foreign Application Priority Data

Dec. 13, 2002 (NL) ..... 1022159

(51) Int. Cl.
*H01R 13/648* (2006.01)

(52) U.S. Cl. ..... 439/610; 439/607

(58) Field of Classification Search ..... 439/610, 439/934, 607

See application file for complete search history.

(56) References Cited

U.S. PATENT DOCUMENTS

| | | | | | |
|---|---|---|---|---|---|
| 3,280,246 | A | | 10/1966 | Lawson et al. | 174/88 |
| 3,435,126 | A | * | 3/1969 | Hamilton | 174/78 |
| 4,592,612 | A | * | 6/1986 | Kikuta | 439/610 |
| 4,744,769 | A | | 5/1988 | Grabbe et al. | 439/284 |
| 4,747,785 | A | * | 5/1988 | Roberts et al. | 439/610 |
| 4,822,304 | A | * | 4/1989 | Herron | 439/610 |
| 4,993,800 | A | * | 2/1991 | Shibata | 385/54 |
| 5,195,909 | A | * | 3/1993 | Huss et al. | 439/610 |
| 6,045,389 | A | | 4/2000 | Ferrill et al. | 439/398 |

FOREIGN PATENT DOCUMENTS

| | | |
|---|---|---|
| EP | 0 583 934 A2 | 2/1994 |
| EP | 0 874 420 A2 | 10/1998 |
| EP | 0 987 790 A1 | 3/2000 |
| EP | 1 024 561 A2 | 8/2000 |

* cited by examiner

*Primary Examiner*—Briggitte R Hammond
(74) *Attorney, Agent, or Firm*—Harrington & Smith, PC

(57) ABSTRACT

The invention relates to a cable connector for a plurality of cables, wherein each of the cables includes at least one conductor and a shielding. The connector includes a cover and at least one connecting means for electrically connecting the shielding and the cover. The connector further includes a holder for at least one of the connecting means and at least one pressure means adapted to develop contact pressure between the connecting means and the cover. Preferably the pressure means relate to flexible mechanical means, such as a clamp and/or clip and/or spring and/or a lever. The invention also relates to a ferrule holder and a method for assembling a cable connector.

17 Claims, 7 Drawing Sheets

CABLE CONNECTOR AND METHOD FOR ASSEMBLING SUCH A CONNECTOR

FIELD OF THE INVENTION

The invention relates to a cable connector for a plurality of cables, each of said cables comprising at least one conductor and a shielding, said connector comprising a cover and at least one connecting means for electrically connecting said shielding and said cover.

BACKGROUND OF THE INVENTION

EP 1 024 561 discloses a connector for a cable with at least one conductor and a shielding, wherein connecting means are provided to establish electrical contact between the shielding and cover means of the connector. The connecting means comprise an inner ferrule and an outer ferrule that have been crimped to the cable.

The prior art connector does not allow the accommodation of a plurality of cables while maintaining sufficient shielding of the cables.

SUMMARY OF THE INVENTION

It is an object of the invention to provide a cable connector for a plurality of cables which is relatively easy to assemble and which exhibits improved shielding performance.

This object is achieved by providing a cable connector characterized by a holder for at least one of said connecting means and at least one pressure means adapted to develop contact pressure between said connecting means and said cover.

The holder provides the possibility to position and retain the connecting means associated with the cables. The pressure means allow the simultaneous exertion of a contact pressure between the cover and various connecting means associated with the various cables in the connector such that good electrical contact between the connection means and the cover can be established. As a result the connector according to the invention provides a good shielding performance. The pressure means are relatively easy to manufacture. The pressure means may refer to mechanical means for exerting the contact pressure. Preferably the pressure means relate to flexible mechanical means. The mechanical means may be suited to exert a contact pressure between the cover and the connecting means without being firmly attached thereto and/or to another component of the connector. These mechanical means may e.g. relate to a clamp and/or clip and/or spring and/or a lever. The mechanical means may also relate to a component that is attached to the connector.

In a preferred embodiment of the invention the holder comprises means for accommodating at least one of said pressure means. In this way the pressure means can be easily inserted in the holder. The holder may be suited to accommodate multiple pressure means. In a preferred embodiment the connecting means comprises a ferrule and the holder comprises a recess for holding the ferrule. Such a recess is a preferred option for the accommodation of the pressure means that allows for easy insertion.

In a preferred embodiment of the invention the ferrule comprises an inner ferrule and an outer ferrule and the shielding of the cables is at least partially sandwiched between the inner ferrule and the outer ferrule. The inner and outer ferrule may have been crimped to at least a part of the cable. Such a ferrule system provides an adequate cable pull off relief, bend relief and twist relief for the cable connector according to the invention. The inner and outer ferrules may be simple cheap, straight, tube-like ferrules. Twist relief is provided by having a non-circular outer ferrule, which shape is obtained in the crimping process. The contact pressure is preferably developed between the outer ferrule of the connecting means and the cover of the cable connector. In that case the holder preferably has an opening allowing for direct contact between the outer ferrule and the connector cover.

In a preferred embodiment of the invention the cover is comprised of at least two releasable parts wherein at least one of the parts is adapted for accommodating the holder. A two-part holder allows for easy installation of the cables and the pressure means in the cable connector.

It should be appreciated that the embodiment described above, or aspects thereof, can be combined.

The invention also relates to a ferrule holder holding a plurality of ferrules of associated cables in a cable connector, wherein the ferrule comprises a recess for accommodating pressure means for developing contact pressure between at least one of the ferrules and a cover of the cable connector. The ferrule holder preferably comprises an opening to allow for direct electrical contact between at least one of the ferrules and the cover of the cable connector.

The invention also relates to method for assembling a cable connector as described above, comprising the steps of:

- positioning said at least one pressure means on said holder such that said connecting means are pushed in a first direction;
- assembling said cover with said holder such that said connecting means are pushed in a second direction, substantially opposite to said first direction, such that a contact pressure develops between said connecting means and said cover.

EP 0 583 934 discloses a high frequency cable connector wherein a grounding spring clip is provided that is positioned intermediate two shielded sub-assemblies for commoning shield members and providing contact portions for mating pins. However the grounding spring clip is not adapted for developing a contact pressure between connecting means and a cover of the connector.

BRIEF DESCRIPTION OF THE DRAWINGS

The invention will be further illustrated with reference to the attached drawing, which shows a preferred embodiment according to the invention. It will be understood that the cable connector according to the invention is not in any way restricted to this specific and preferred embodiment.

DETAILED DECRIPTION OF THE INVENTION

Figure 1A:
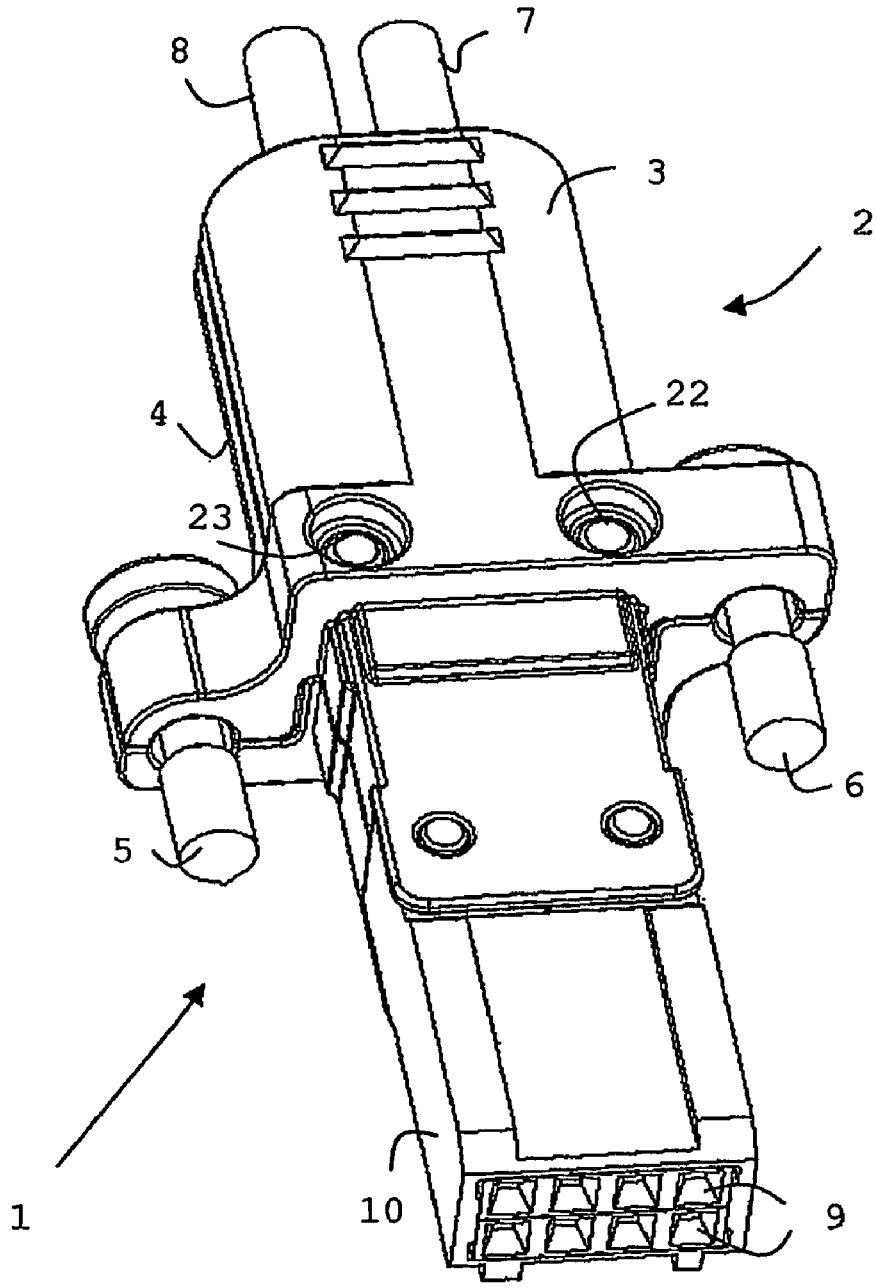
FIGS. 1A-1C show an assembled cable connector and cutaway views of the cable connector according to an embodiment of the invention.

FIG. 1A shows a cable connector 1 comprising a cover 2 having two cover halves 3 and 4. Cover 2 typically is made out of metal, such as zinc, to provide electromagnetic shielding and robustness of the connector 1. Bolts 5 and 6 are used to lock the connector 1 to a counter part. FIG. 1 shows a cable connector 1 adapted for two cables 7 and 8, which arrangement is further discussed in detail below. It should be appreciated that the cable connector may be arranged for more than two cable without departing from the spirit of the invention. Further components of the cable connector 1 that are visible in FIG. 1 include the terminal blocks 9 that provide solder islands for the wires of the cables 7, 8 and an insulating shroud 10 for positioning and retaining the terminal blocks 9 and provide polarization and guiding. The shroud 10 moreover prevents bending between the terminal blocks 9 and the cover halves 3, 4.

Figure 1B:
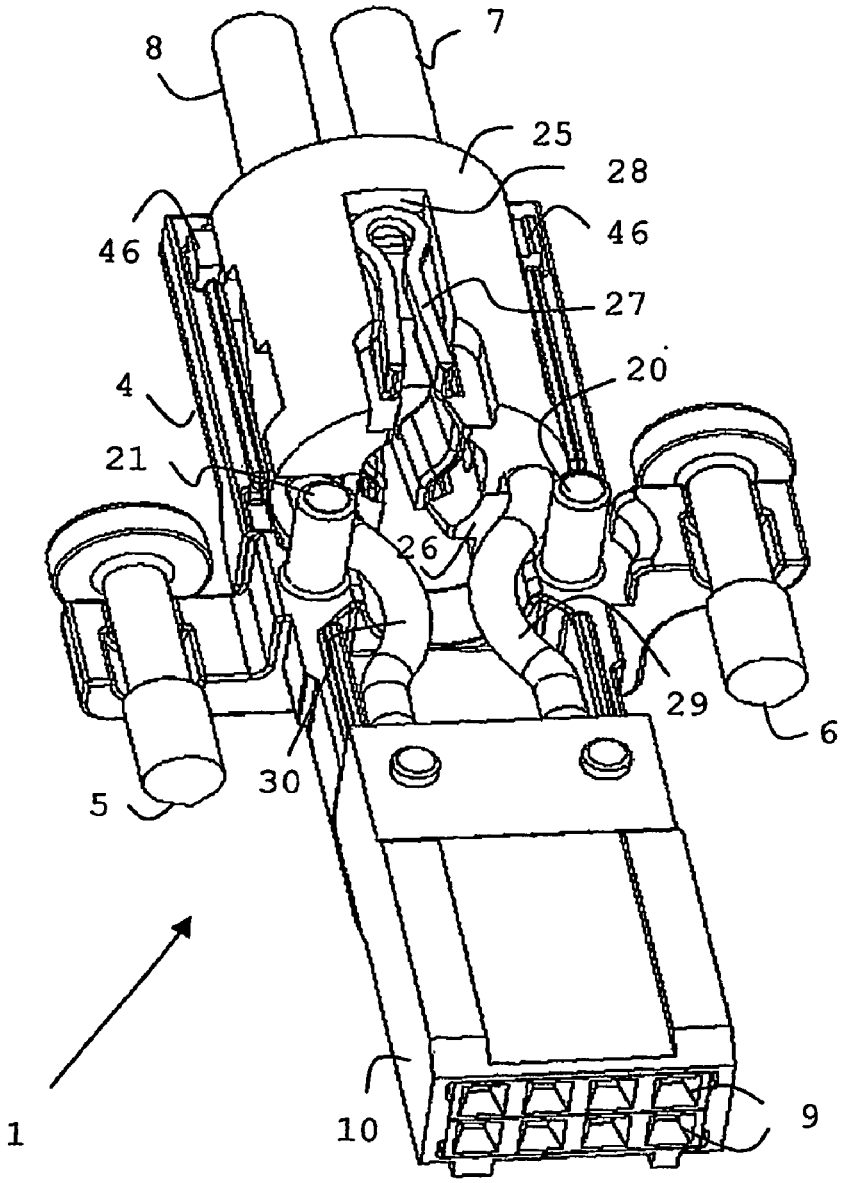

FIG. 1B shows the cable connector 1 of FIG. 1A, without the cover half 3 as to provide a clear view on the inside of the cable connector 1. Guiding pins 20, 21 are provided on cover half 4 to facilitate and execute the attachment between the cover halves 3, 4 by fitting the guiding pins 20, 21 in corresponding holes 22, 23 of cover half 3 (shown in FIGS. 1A and 2A). The cable connector 1 comprises a holder 24, which will also be referred to a ferrule holder 24 hereinafter. The ferrule holder 24 may be made of one piece or may comprise several parts 25, 26 as shown in FIG. 1B. An advantage of such a ferrule holder is that it provides an appropriate reference for the positioning of the terminal blocks 9 as a result of which good quality control is obtained in termination of the individual wires of the cables 7, 8 in the terminal blocks 9. The ferrule holder 24 comprises means for accommodating pressure means 27 such as recess 28. Preferably the pressure means 27 relate to flexible mechanical means, such as a clip 27. Parts 29 and 30 preferably is an Al-foil present underneath the conductive shielding or braid of the cable, but may also be the insulation around the conductors. A more detailed view of the ferrule holder 24 and the flexible clip 27 is provided in FIGS. 2B and 2E respectively.

Figure 1C:
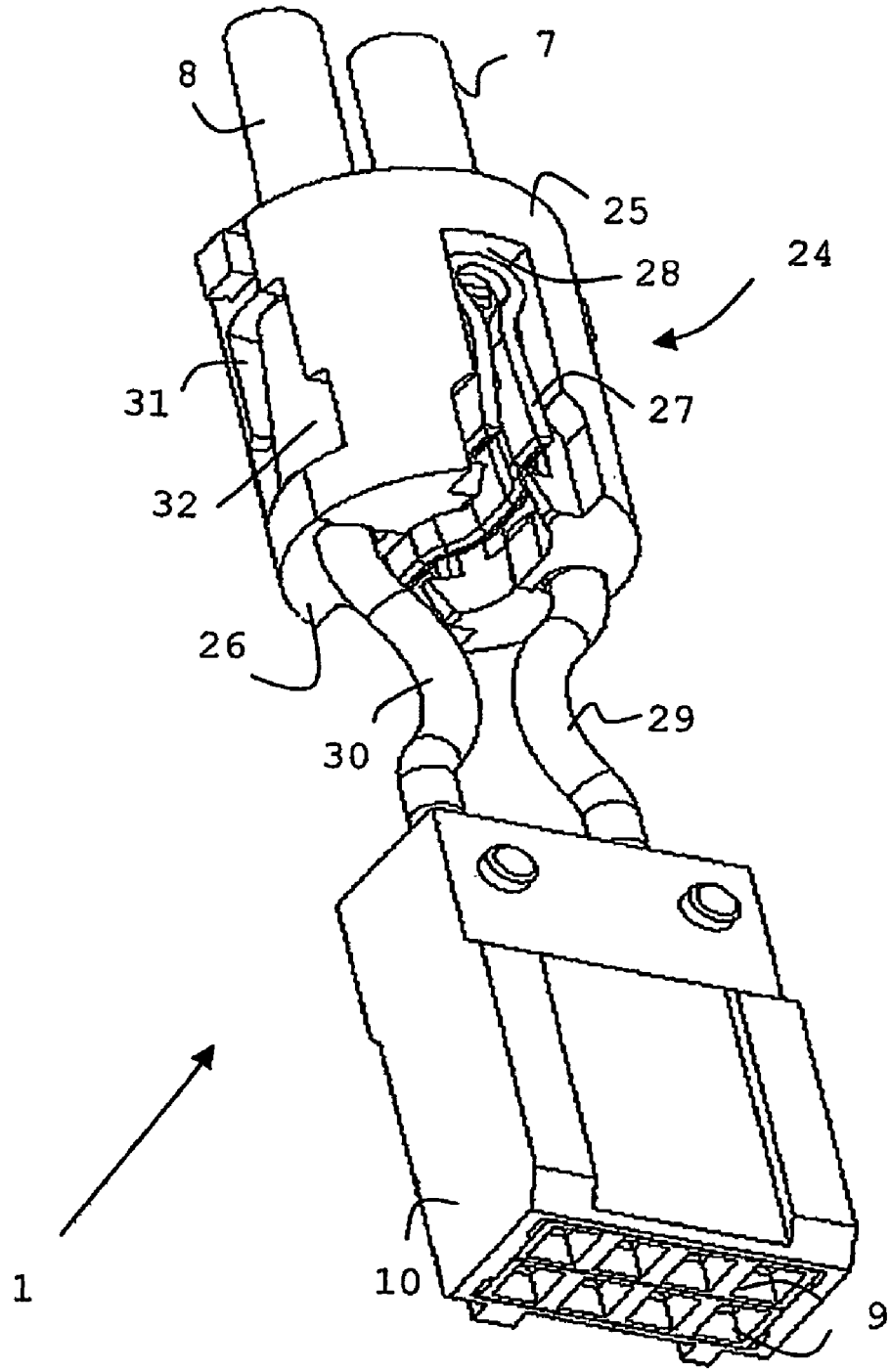

In FIG. 1C the cable connector 1 is shown without the cover 2. It is clearly visible that in this embodiment the ferrule holder 24 comprises the parts 25, 26. The parts 25, 26 provide an opening 31 through which connecting means 32 are allowed to make a direct electrical contact with the cover 2, shown in FIGS. 1A and 1B. The provision of the pressure means 27 drives the connecting means 32 towards this cover 2. This mechanism is more clearly illustrated in FIG. 2D and in FIG. 3A. The connecting means 32 will hereinafter also be referred to as ferrule 32. Ferrule 32 is further discussed with respect to FIGS. 3A and 3B. It should be appreciated however that the connecting means 32 may also refer to the shielding of the cable 8 itself, such that the pressure means 27 develop contact pressure between this shielding and the cover 2. In that case the shielding of the cable 8 and the connecting means 32 are one and the same.

The cable connector 1 shown in FIG. 1C is shown as a symmetrical cable connector, i.e. a single flexible clip 27 is positioned axially and employs to develop a contact pressure between ferrules 32 associated with both cables 7 and 8 and the cover 2. The cover halves 3, 4 of cover 2 contribute equally to the area for the opening 31 on both sides of the ferrule holder (in FIG. 1C, the opening 31 is only shown on one side). It should however be appreciated that such a symmetrical arrangement, although convenient, is not essential for the invention. It can e.g. be imagined that the parts 25, 26 of the ferrule holder 24 do not have an equal contribution to the area of the openings 31. Moreover the flexible clip 27 may be manufactured with a non-symmetrical shape as a result of which it can be positioned elsewhere in the cable connector 1 and/or the ferrule holder 24. Alternative non-symmetrical arrangements, including arrangements with more than two cables or more than one ferrule holder 24, fall within the scope of the invention. It should be understood that in the case of multiple ferrule holders 24 a symmetrical arrangement of the cable holder 1 can be achieved.

Figure 2A:
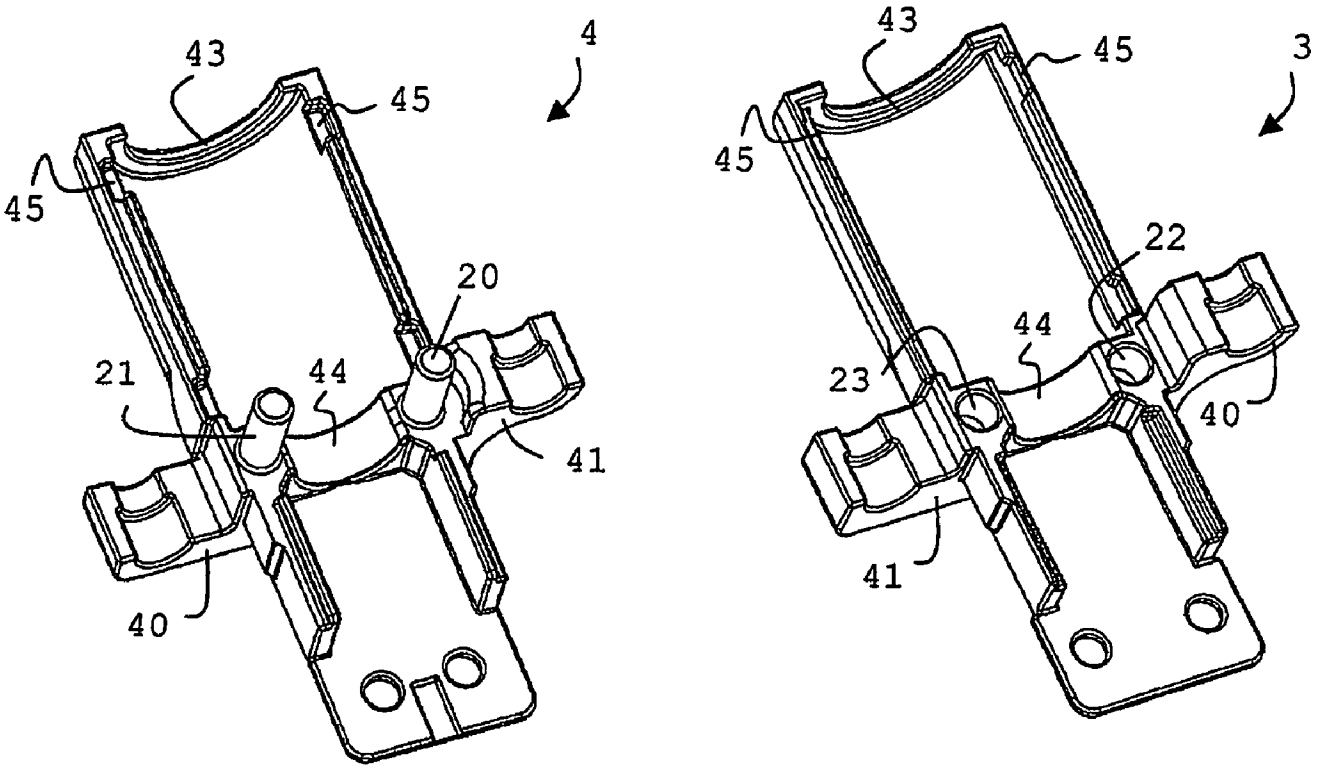
FIGS. 2A-2E show detailed parts of the cable connector shown in FIGS. 1A-1C.

FIG. 2A shows detailed views of the cover halves 3 and 4 of the cover 2 of cable connector 1. Cover halves 3 and 4 include corresponding parts 40, 41 for reception of the bolts 5, 6. Moreover cover halves 3 and 4 comprise guiding pins 20, 21 and corresponding holes 22, 23 to facilitate assembly of the cable connector 1. The cover halves 3 and 4 define a cable entrance 43 and a rib or wall 44. The cable entrance 43 and the rib 44 together with the sidewalls of the cover halves 3 and 4 together are adapted to accommodate and preferably mount the ferrule holder 24 in the cover 2 as shown in FIG. 1B. Mounting of the holder 24 in the cover 2 is facilitated by recesses 45 in the cover halves 3, 4 that are adapted to fit with corresponding lugs 46 of the holder 24 (shown in FIGS. 1B and 2B, 2C).

Figure 2C:
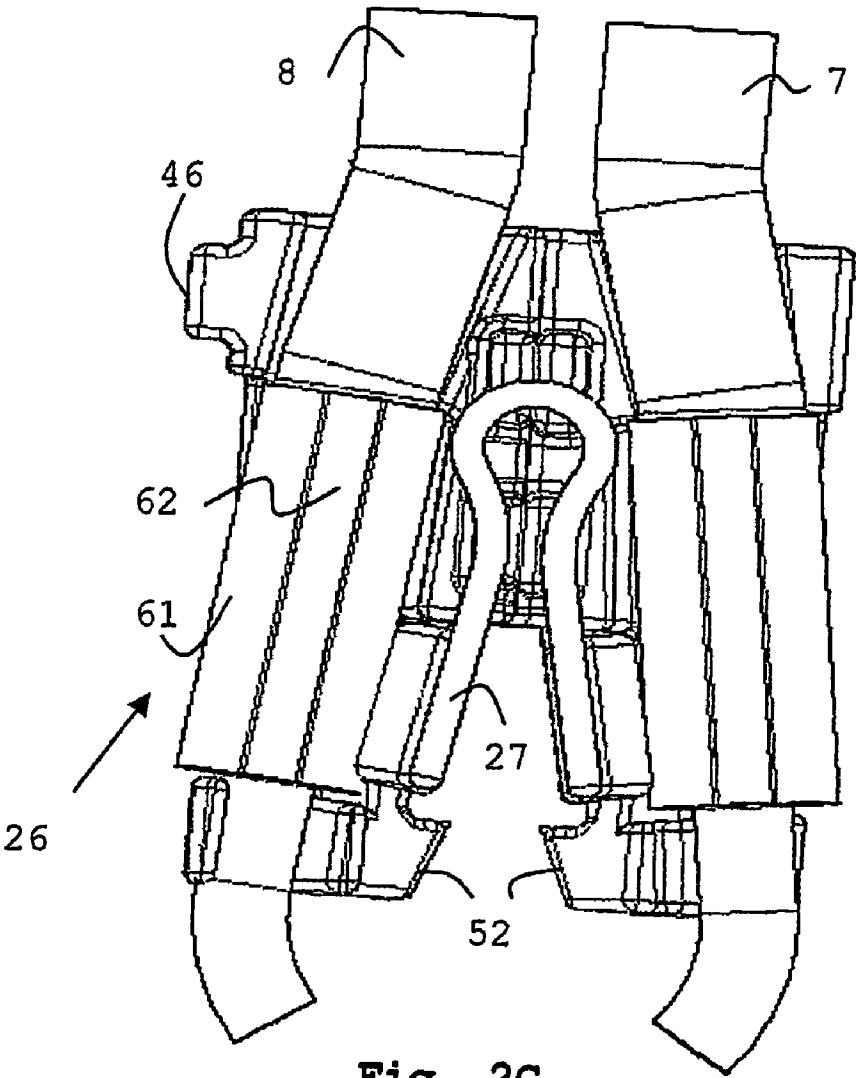
Figure 2B:
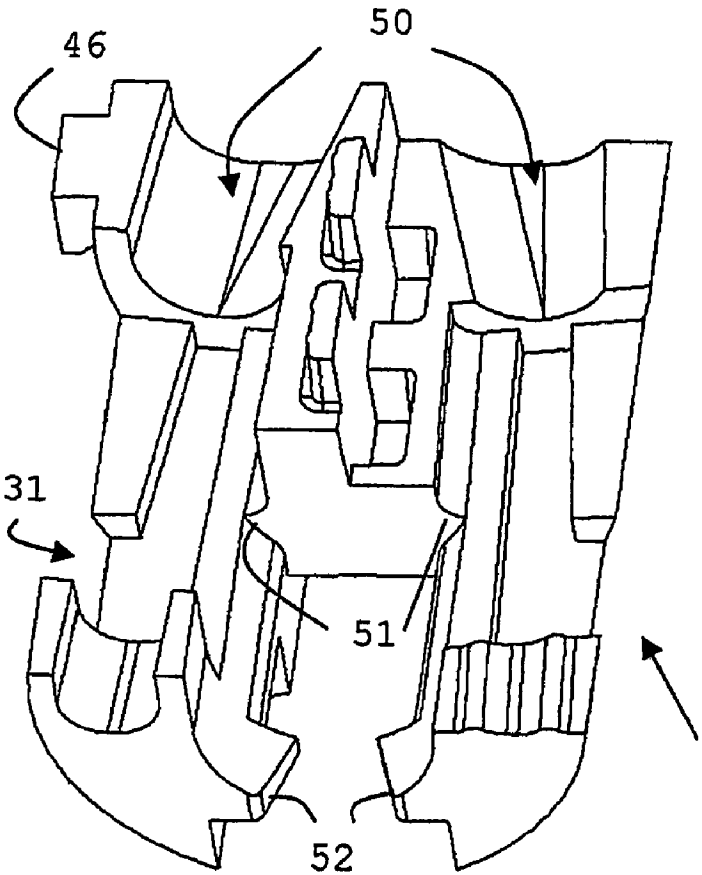

FIGS. 2B and 2C show a detailed view of the holder part 26 with and without cable 8 respectively. The ferrule holder part 26 is provided with several recesses and lugs to receive and attach to the ferrule holder part 25.

In FIG. 2B it is displayed that the holder part 26 comprises slots 50 for parts of the cables 7, 8 of the cable connector 1. Moreover the holder part 26 exhibits an opening 31 to allow direct electrical contact between the ferrule 32 (shown in FIG. 2C) and the cover 2. Finally the holder part 26 is adapted to accommodate the flexible clip 27, e.g. by the provision of the ridge 51 and hooks 52, the latter enabling the clip 27 to be compressed when mounting the ferrules 32 in the ferrule holder part 25.

In FIG. 2C the slots 50 are shown with cables 7, 8. Slots 50 of the ferrule holder 24 provide adequate guidance for the cables 7, 8, such that good quality control of during the termination of the wires of the cable 8 in the terminal blocks 9 is obtained. The connecting means or ferrule 32 associated with the cables 7, 8 are locked in the ferrule holder part 26. This locking of the ferrule 32 in the ferrule holder 24 provides adequate cable pull-off relief, bend relief and twist relief. Clip 27 is shown to exert an outward force on the ferrule 61.

Figure 2E:
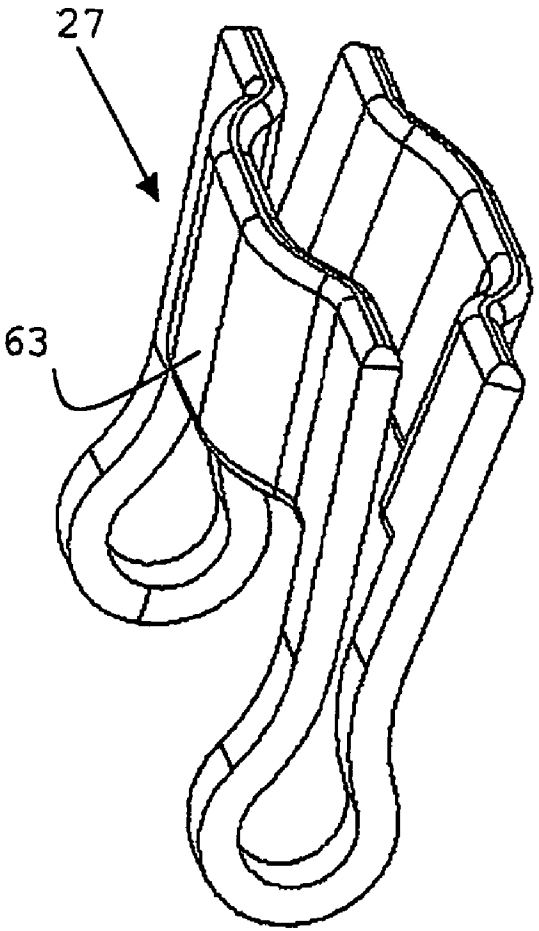
Figure 2D:
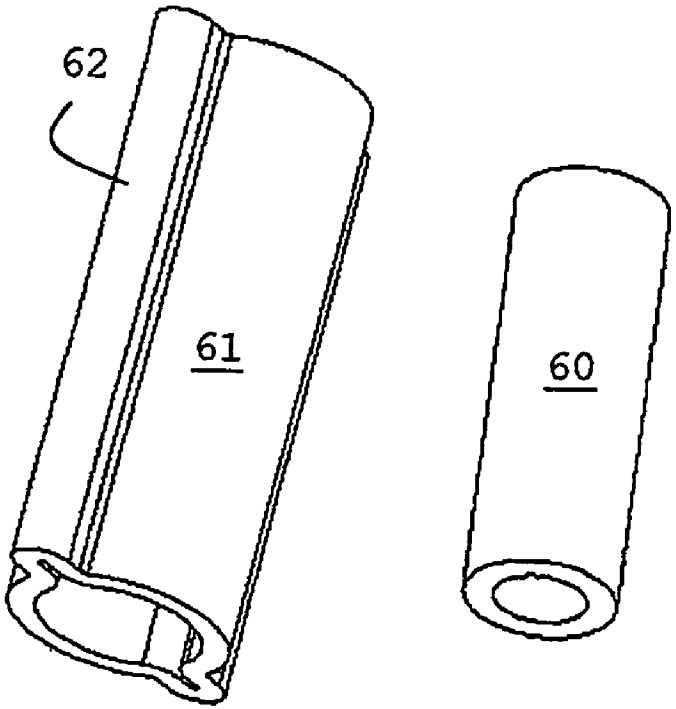

FIG. 2D shows a preferred embodiment of the ferrule 32. Ferrule 32 preferably relates to a combination of an inner ferrule 60 and an outer ferrule 61, that can be attached to the cable 8 by a crimping process as e.g. described in EP 0 987 790 of the applicant which is incorporated in the present application with respect to the crimping process by reference. In short the cable 8 comprises an outer insulating jacket and a conductive shielding or braid. The inner ferrule 60 is placed underneath the conductive shielding of the cable 8. Subsequently the outer ferrule 61 is slid over the shielding that is laid over the inner ferrule 60, such that this part of the shielding is sandwiched between the inner ferrule 60 and the outer ferrule 61. Finally the outer ferrule is crimped, such that a good electrical connection is obtained between the inner ferrule 60, the shielding and the outer ferrule 61. Simultaneously the outer ferrule 61 partly crimped on the outer jacket of the cable 8 for cable bend relief. During the crimping of the outer ferrule 61, the non-circular shape indicated by the ridge 62 may be formed. This ridge 62 facilitates twist relief of the cable 8 when the outer ferrule 61 is locked in the ferrule holder 24, as shown in FIG. 2C. Both the inner ferrule 60 and the outer ferrule 61 may be are straight cheap tubes.

FIG. 2E shows a detailed view of the flexible clip 27. The clip 27 is formed such that when it is inserted in the recess 28 of the ferrule holder 24, it develop a contact pressure on the outer ferrule 61 as a result of which a least a part of the outer ferrule 61 is pressed by the part 63 of the clip 27 through the opening 31. The flexible clip 27 as such is an already existing and cheap component. The clip 27 may be made of insulating material. However, if the clip 27 is electrically conductive it may contribute to the electromagnetic shielding performance of the cable connector 1. Further the flexible clip 27 may formed such that it contributes in keeping the parts 25, 26 of the ferrule holder 24 together and in locking of the ferrule 32 in the ferrule holder 24.

The cable connector 1 is preferably assembled as follows. First the crimped ferrules 32 are positioned in the ferrule holder part 26 and subsequently the ferrule holder part 25 is placed on top such that the crimped ferrule 32 is locked inside the ferrule holder 24. It is noted that if the ferrule holder 24 is formed as an integral part, the crimped ferrules need to be pushed or pulled in the ferrule holder 24. Next the flexible clip 27 is positioned, e.g. in the recess 28 of the ferrule holder 24. If the flexible clip 27 is in the right position, it will push the ferrule 32 in a first direction such that the ferrule 32 is pushed at least partially though the opening 31 in the ferrule holder 24. Subsequently the assembly is placed inside the cover half 4, employing recesses 45 and corresponding lugs 46, such that the ferrule 32 is pushed in a second direction, substantially opposite to the first direction, i.e. a force is exerted on the ferrule 32, driving it back inwards the opening 31. As a result a contact pressure is developed between the ferrule 32 and the cover half 4 such that a good electrical contact is obtained between the ferrule 32 and the cover half 4. Since the shielding of the cable 8 was sandwiched between the inner ferrule 60 and the outer ferrule 61, a good electrical contact is obtained between the shielding and the cover half 4, i.e. appropriate shielding is obtained. Finally the cover half 3 is placed on the cover half 4, employing guiding pins 20, 21 and corresponding holes 22, 23.

Figure 3B:
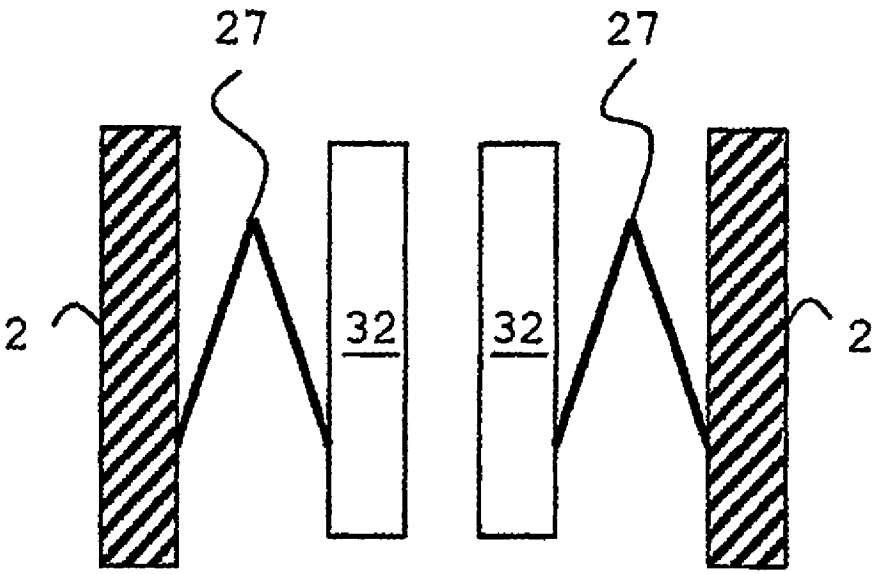
FIGS. 3A and 3B show schematical illustrations of the cable connector shown in FIG. 1 and an alternative embodiment of the invention respectively.
Figure 3A:
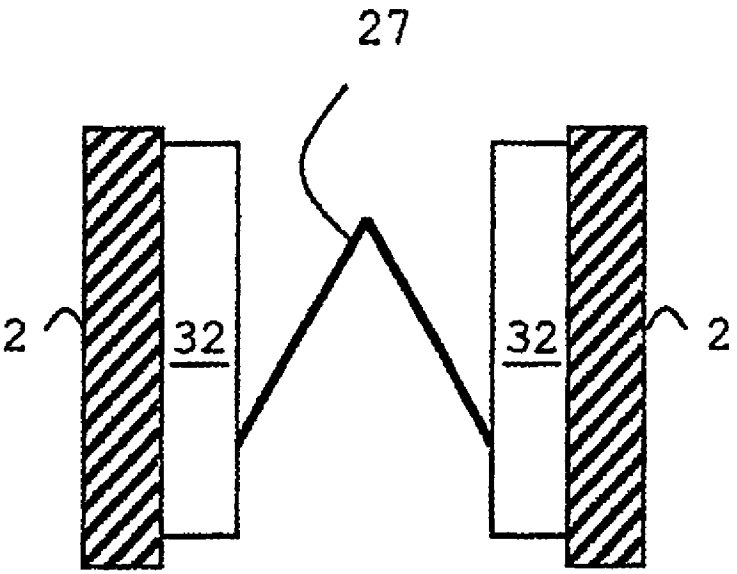

FIG. 3A shows a schematic illustration of the function of the flexible clip 27 in developing a contact pressure between the ferrule 32 and the cover 2, as discussed in detail above.

FIG. 3B shows a schematic illustration of an alternative embodiment, wherein the pressure means 27 are positioned between the ferrule 32 and the cover 2. Since the ferrule 32 is locked in the ferrule holder 24, a contact pressure may develop between the cover 2 and the ferrule 32 in such an arrangement as well, although the pressure means 27 pushes the cover and the ferrule 32 away from each other. However, in this arrangement the pressure means 27 should be made of electrically conductive material in order to obtain effective shielding of the cable connector 1.

Finally it is noted that the cable connector 1 and more specifically the ferrule holder 24 can also be applied with more than two ferrules and cables or more ferrule holders, without departing from the spirit of the invention.

The invention claimed is:

1. Cable connector for a plurality of cables, each of said cables comprising at least one conductor and a shielding, said connector comprising a cover and at least one connecting means for electrically connecting said shielding and said cover characterized in that the cable connector further comprises a holder for at least one of said connecting means and at least one flexible pressure means adapted to provide a spring biasing force to develop direct contact pressure of said connecting means against said cover.

2. Cable connector according to claim 1, wherein said holder comprises means for accommodating at least one of said pressure means.

3. Cable connector according to claim 1, wherein said connecting means comprises a ferrule and said holder comprises a recess for accommodating said ferrule.

4. Cable connector according to claim 3, wherein said ferrule comprises an inner ferrule and an outer ferrule and said shielding of said cable is at least partially sandwiched between said inner ferrule and said outer ferrule.

5. Cable connector according to claim 4, wherein said inner ferrule and said outer ferrule have been crimped to said cable at least partially.

6. Cable connector according to claim 4, wherein said holder and/or said pressure means are adapted to lock said outer ferrule in said holder.

7. Cable connector according to the claim 4, wherein said contact pressure is developed between said outer ferrule and said cover.

8. Cable connector according to claim 4, wherein said holder comprises at least one opening to allow electrical contact between said outer ferrule and said cover.

9. Cable connector according to claim 1, wherein said pressure means comprises at least one flexible clip.

10. Cable connector according to claim 1, wherein said holder is comprised of at least two releasable parts, at least one of said parts being adapted for accommodating said pressure means.

11. Cable connector according to claim 1, wherein said pressure means is adapted to simultaneously develop contact pressure between said cover and at least a first and a second connecting means associated with a first and second cable of said plurality of cables.

12. Ferrule holder for holding a plurality of ferrules of associated cables in a cable connector, said ferrule holder comprising a recess for accommodating flexible pressure means, said pressure means being adapted to develop contact pressure between at least one of said ferrules and a cover of said cable connector.

13. Ferrule holder according to claim 12, wherein said ferrule holder comprises an opening to allow electrical contact between at least one of said ferrules and said cover.

14. Method for assembling a cable connector according to claim 1, comprising the steps of:

positioning said at least one flexible pressure means on said holder such that said connecting means are pushed in a first direction;

assembling said cover with said holder such that said connecting means are pushed in a second direction, substantially opposite to said first direction, such that a contact pressure develops between said connecting means and said cover.

15. Cable connector according to claim 1, wherein said flexible pressure means comprises at least one deflectable spring section.

16. Cable connector according to claim 1, wherein said flexible pressure means is mounted at least partially inside said holder, and wherein said cover at least partially surrounds said holder.

17. A cable connector for a plurality of cables, each of the cables comprising at least one conductor and a shielding, the connector comprising a cover and at least one connecting member for electrically connecting the shielding and the cover, wherein the cable connector further comprises a holder for the at least one connecting member and at least one flexible pressure member adapted to provide a spring biasing force to bias the connecting member and the cover against each other.

* * * * *